United States Patent [19]

Snyder

[11] 4,080,099

[45] Mar. 21, 1978

[54] PROPELLER

[75] Inventor: Richard H. Snyder, Oshkosh, Wis.

[73] Assignee: Brunswick Corporation, Skokie, Ill.

[21] Appl. No.: 688,917

[22] Filed: May 2, 1976

[51] Int. Cl.[2] ..... B63H 1/26

[52] U.S. Cl. ..... 416/146 R; 416/234; 416/238

[58] Field of Search ..... 416/146, 238, 234, DIG. 2, 416/223, 62; 415/121 B

[56] References Cited

U.S. PATENT DOCUMENTS

| | | | |
|---|---|---|---|
| 368,416 | 8/1887 | Mosher | 416/234 |
| 602,651 | 4/1898 | Adam | 416/DIG. 2 X |
| 885,174 | 4/1908 | Perkins | 416/234 |
| 887,156 | 5/1908 | Voss | 416/234 |
| 1,087,203 | 2/1914 | Walters | 416/234 |
| 1,390,397 | 9/1921 | Svenson | 416/146 |
| 1,403,729 | 1/1922 | Balaguer | 416/DIG. 2 X |
| 1,593,516 | 7/1926 | Sutter | 416/238 |
| 1,813,540 | 7/1931 | Laska | 416/146 |
| 1,857,327 | 5/1932 | Pilet | 416/234 |
| 2,011,821 | 8/1935 | Meyer et al. | 416/223 |
| 2,143,693 | 1/1939 | Harris | 416/146 |
| 3,081,826 | 3/1963 | Loiseau | 416/238 |
| 3,226,031 | 12/1965 | Holland | 416/223 X |
| 3,367,423 | 2/1968 | Van Ranst | 416/238 X |
| 3,371,720 | 3/1968 | Blanchard | 416/146 |
| 3,619,083 | 11/1971 | Witte | 416/146 X |

FOREIGN PATENT DOCUMENTS

| | | | |
|---|---|---|---|
| 213,545 | 11/1956 | Australia | 416/238 |
| 31,342 | 3/1917 | Norway | 416/238 |

*Primary Examiner*—Everette A. Powell, Jr.
*Attorney, Agent, or Firm*—Lewis L. Lloyd

[57] ABSTRACT

A propeller having a specified combination of blade sweep, camber and rake which provides distinct operating advantages when utilized on pleasure boats; and further including weed cutting and protection features which make the prop particularly suitable for use on outboard motors and stern drives employing underwater exhaust through the lower gear case housing. Propeller blade rake and camber are adjusted as described to improve performance of light to moderately loaded, medium to high speed pleasure boats. The blades are swept aft and weed cutting blade-like fingers extend forwardly of the propeller blades to prevent weeds from accumulating forward of the prop and blocking the exhaust passageway.

3 Claims, 5 Drawing Figures

PROPELLER

BACKGROUND OF THE INVENTION

The invention is in the field of propellers for marine outboard drive units and more specifically concerns a novel propeller having particular utility when enployed with drive units which employ underwater exhaust through the lower gear case.

In recent years outboard motors and marine stern drive units for pleasure boats have incorporated underwater engine exhaust systems which route the exhaust down through the drive shaft housing, aft through the lower gear case and out an annular passage through the propeller hub. These units are commonly called "through-the-hub exhaust" systems and are in common use around the world. One such system is presently manufactured by the Mercury Marine Division of Brunswick Corporation under the trademark of Jet-Prop™, and a similar system is illustrated in U.S. Pat. No. 2,948,252 issued to Charles F. Alexander. The patent describes such an exhaust system for outboard motors.

Prior to the invention it was, and is, common practice to utilize through-the-hub-exhaust type (T-H-E) propellers, as described in the Alexander patent, with underwater exhaust systems. The hub exhaust passage of such propellers was specifically designed to keep the exhaust gases from causing the propeller to ventilate and the flaired hub creates a low pressure area immediately aft of the prop. This low pressure area reduces the exhaust back pressure on the engine and increases engine efficiency. The main objective of such systems has always been to reduce exhaust noise by underwater exhaust and at the same time minimize the effect of increased drag created by the increase in size of the lower gear case required to accommodate the exhaust passage.

Racing outboards are an exception to the above. While all stock outboards equipped with through-the-hub exhaust systems are sold with T-H-E propellers as standard equipment, such engines have been equipped with non-T-H-E propellers in special purpose configurations for stock class racing. When so equipped, the engines are preferably mounted high on the transom to reduce drag so that a good portion of the upper half of the propeller is out of the water when the boat is moving at high speed. Racing propellers used under these circumstances are designed to operate partially out of the water but are effective in driving light weight race boat hulls only and are not generally as suitable for use on medium to high speed pleasure boats for which the prop of the invention was developed.

One of the problems with drive units incorporating underwater exhaust systems using T-H-E propellers typical of the current art is that the combination is sensitive to variation in its height adjustment on the transom of the boat. More specifically such props are intolerant of the introduction of surface air under the "anti-cavitation" plate which occurs when the engine is mounted with the anti-cavitation plate higher than the boat bottom. While the optimum height adjustment depends primarily upon the hull design and operating speed, it was generally true that the anti-cavitation plate of the lower unit has to ride on the water so as to shield the prop from surface air, otherwise the prop will "break loose", ventilate and lose thrust. This most often occurs when accelerating onto a plane, in a turn, or when the unit is trimmed up (tilted about a horizontal axis) to achieve a more efficient or desired boat attitude.

A distinction should be made between a total "break loose" or "blow out" of the prop which is undesirable and normally requires a significant reduction in throttle to shed the air, exhaust, or cavitation bubbles, and a partial, ventilation which normally does not require a change in throttle to ultimately eliminate the condition when planing speed is reached. A primary advantage of the prop of the invention is that it can withstand a partial ventilation whether caused by underwater exhaust or other operational factors; so that its utility is not limited to T-H-E drive units.

Prior to the invention, non-T-H-E propellers were not considered suitable for general use on pleasure boats operated at moderate top speeds of between 30 and 50 mph, and, as mentioned above, drive units on non-racing hulls were always mounted with the anti-cavitation plate at or below the water level at planing speeds (at or below an extension of the boat bottom).

Through experimentation and test, the applicant has discovered that by proper use of blade rake and camber (hereinafter explained) a non-T-H-E propeller can be made to operate successfully on standard T-H-E outboards and stern drives driving medium to high speed pleasure boats with a number of advantages (hereinafter discussed) over use of the standard T-H-E propeller.

Another problem which had to be overcome before the non-T-H-E propeller could be used with standard T-H-E outboards or stern drives was that of weeds wrapping around the propeller drive shaft of hub forward of the blades. Weeds wrapped in this manner will block the exit of the exhaust passage from the lower gear case and choke the engine, so that it will die at speeds above idle. To solve this problem the invention includes weed cutting fingers radially off-set from the propeller shaft and extending axially between the blades and the exhaust outlet in the lower gear case housing. Also, the propeller blades are swept aft to more readily permit weeds to slide thereover and not be trapped forward of the blades where they will tend to wrap around the propeller drive shaft and hub. In some cases, particularly at a slow idle, weeds will wrap around the outside of the fingers; but as the fingers are radially off-set from the hub of the prop ample room is provided for the exhaust to escape. When the engine is accelerated, the higher rotational and forward velocities cause the loosely wrapped weeds to be cut up by the "finger" and thrown off.

SUMMARY OF THE INVENTION

In its broadest concept, the invention comprises a propeller having a hub adapted to mate with a propeller shaft, and a plurality of propeller blades extending radially outwardly from said hub; said blades having a modified circular arc chord section, rounded tips and a selected combination of sweep, rake, and camber which give it exceptional performance characteristics.

In another aspect, the invention comprises a non-T-H-E prop having particular utility when employed with a T-H-E drive unit having a propeller shaft and an exhaust outlet around said shaft, said propeller having a hub adapted to mate with the propeller drive shaft, a plurality of blades mounted to said hub, and a plurality of weed cutting fingers extending forwardly of said blades, and positioned adjacent the hub in close axially overlapping relationship to the exhaust outlet of the T-H-E drive unit.

Several of the advantages of the propeller of the invention and its combination with T-H-E drive units are:

1. The propeller is lighter in weight and is less expensive to manufacture than a T-H-E counterpart of the same material.

2. The propeller is more efficient than prior art production props with the same blades but of the T-H-E configuration.

3. The propeller in many cases provides better acceleration than its T-H-E counterpart.

4. The propeller provides an improvement in reverse thrust over that achievable with a T-H-E prop.

5. Reduced tendency for the propeller to totally "break loose".

6. The propeller-drive combination can be operated successfully on moderate speed pleasure boats (30–50 mph) at prop shaft heights above those possible with T-H-E propellers of conventional production design, thus reducing drag.

7. A weed shedding characteristic far superior to prior non-T-H-E props and as good or better than current T-H-E props.

Other objectives, advantages, and various further features of novelty and invention will be pointed out or will occur to those skilled in the art from a reading of the following specification in conjunction with the accompanying drawings.

DETAILED DESCRIPTION OF THE PREFERRED EMBODIMENT

Figure 1:
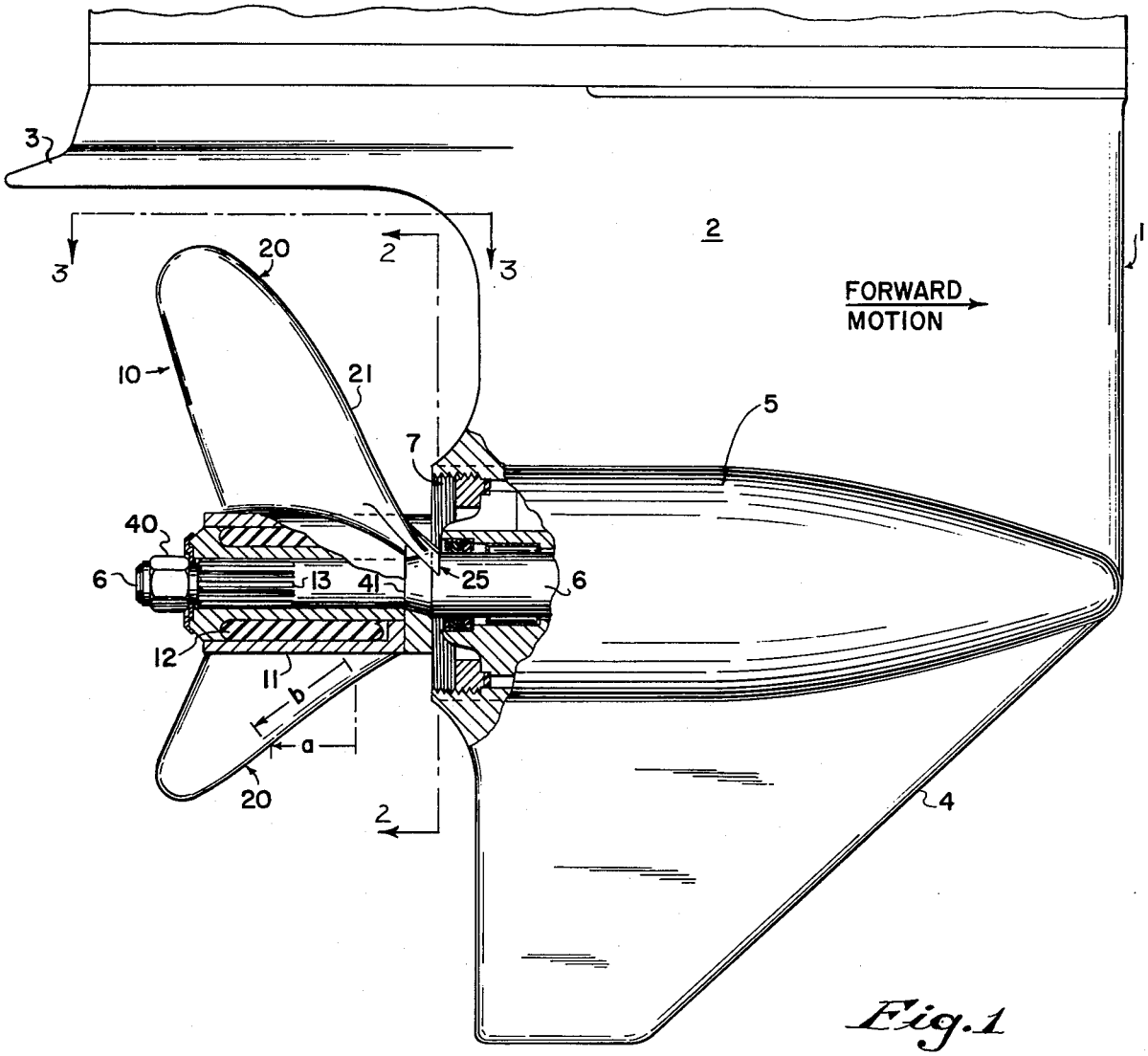
FIG. 1 is a side elevation of a through-the-hub-exhaust lower gear case of a marine drive with a propeller of the invention attached.

Referring now to FIG. 1, numeral 1 designates a so-called lower unit representative of a marine stern drive or outboard motor. Such units are well known to those skilled in the art and generally comprise a housing 2 of die cast aluminum, an integral anti-cavitation plate 3, a skeg 4, and a torpedo 5 which houses the drive gears for the propeller shaft 6. A typical unit of this type is illustrated in the aforementioned Alexander patent and hundreds of thousands are in public use. The housing 2 includes an internal exhaust gas passageway which terminates at the aft end of the torpedo 5 in an annular opening 7.

The propeller of the invention 10 includes a hub 11 adapted to mount upon the propeller shaft 6. While it is not part of the invention, the hub here illustrated includes a slip clutch 12 developed by the assignee and which is in use throughout the world. Propellers utilizing this feature may be splined to the propeller shaft by splines 13 as the slip clutch mechanism 12 protects the engine from sudden stoppage should the prop engage a heavy underwater obstacle.

One novel aspect of the invention resides in the shape of the blades 20. Note that the leading edges 21 of the blades are swept aft or opposite to the direction of forward motion. This enables weeds encountered to slide aft and over the blades instead of being hooked by a forward projection of the leading edge of the blades as has been common with prior production props. Blade sweep, as used herein, is defined (see FIG. 1) as a ratio of the distance of retreat "*a*" of the leading edge of the blade (measured axially from a plane perpendicular to the axis of the propeller) to the distance "*b*" measured along the blade edge. An aft blade sweep of at least 0.5 is desired with 0.6 preferred. Overall blade sweep would be the retreat of the blade edge from root to tip. Greater blade sweep would of course shed weeds better but would require thicker, less efficient blade sections to support the blades.

Another novel aspect of the propeller of the invention is the particular combination of blade camber and rake. Blade "camber" is a pitch progression described by those skilled in the art as a rate of change of pitch over a given arc (degrees of revolution) of the propeller blade. Experience and experimentation indicate that an average pitch progression (increase) of between 0.05 in. (0.127 cm) and 0.15 in. (0.381 cm) per 10° of blade arc between the leading and trailing edges of the blades (measured along a median radius) gives good performance, with a pitch progression of 0.10 in. (0.254 cm) per 10° preferred.

Blade "rake" is described by those skilled in the art as any line formed by the intersection of a plane passing through the rotational centerline of the propeller and the high pressure face of a blade. Blade rake may be either straight line or curved and is measured from the diameter of the torpedo 5 outwardly to the edge of the blade on the positive pressure side of the blade. For purposes of the invention, an overall rake, flat or curved, of between 15° and 25° is acceptable with a parabolic rake approximately equivalent to a 16 inch (40.6 cm) radius being very satisfactory.

During development it was found that a 14 inch (35.6 cm) prop of the invention having a rake defined by the parabola $Y^2 = 25 \times$ (which provides an equivalent flat rake of about 20°) gave very satisfactory results with a torpedo diameter of 4.25 inches (10.8 cm).

Satisfactory results are here defined as the ability of the prop to retain its bite and not totally "break loose" when accelerating in a turn at higher angles of trim where T-H-E props would totally "break loose", necessitating reduction of throttle to enable the prop to recover from the lost thrust condition.

Propellers having at least 15° flat "rake" have worked well in tests using outboards and stern drives of over 75 hp turning 13 to 15 inch (33 to 38 cm) diameter propellers at speeds ranging from 45 to 80 (84 to 129 kph). However, a 15° rake did not work well on a smaller engine at lower speeds. It is presently felt that the propeller of the invention loses effectiveness at lower power and speeds below about 30 mph.

Figure 4:
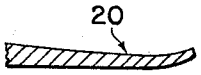
FIG. 4 is a cross-sectional view taken along line 4—4 of FIG. 2.
Figure 5:
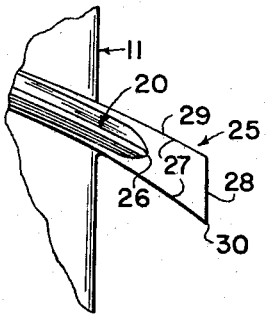
FIG. 5 is a top view of a propeller blade and weed cutting finger of the invention taken along line 5—5 of FIG. 2.

To further optimize performance of the propeller of the invention the blade area ratio should be 50% plus or minus 10%. Blade area ratio is defined as the ratio of the total positive pressure surface area of the blades, measured outwardly from the torpedo diameter, to the area of the circle the blade tips proscribe. Preferably the blade should have a modified circular arc chord section, with maximum blade thickness at a point between 50% and 80% of the chord length back from the leading edge of the blades, preferably 65%. Rounded blade tips are preferred. Trailing edges of the blades should be cupped as illustrated in FIG. 4 on a radius of curvature between 1.0 and 3.0 inches (2.5 and 7.6 cm) with 2.0 in. (5.1 cm) preferred, to achieve a blade edge offset of between 0.060 and 0.100 inches (0.15 and 0.25 cm) with 0.080 inches (0.20 cm) preferred. "Cupping" of the propeller blade 20 provides a rapid increase in camber at the trailing edge and the curvature begins generally along line 22 of FIG. 2 and proceeds along the trailing edge of the blade.

Tests conducted by applicant have repeatedly demonstrated that propellers constructed within the above specifications will not totally "break loose" where their counterpart T-H-E propellers will totally break loose when operated under dementing but not uncommon conditions. This phenomena is not entirely understood at this time, but the relationship between this phenomena and the above described camber and rake have definitely been established.

Figure 2:
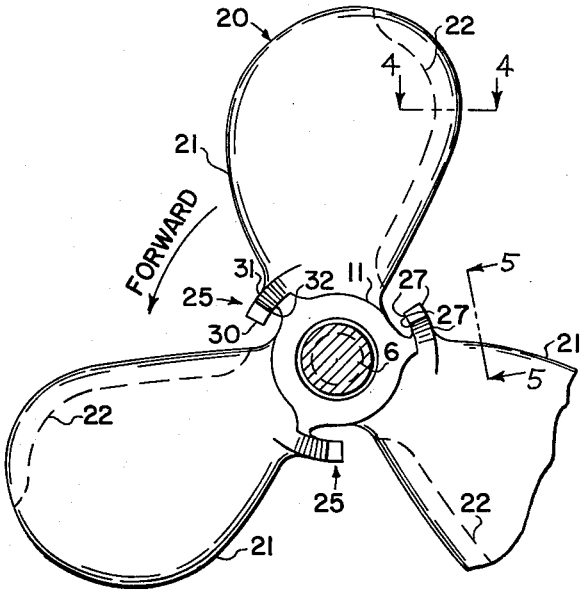
FIG. 2 is a front view of a propeller of the invention.

The weed cutting fingers 25 are illustrated in FIGS. 1, 2, 3 and 5. Since all fingers are alike, only one will be described. Each finger 25 is formed integrally with a blade 20 and projects forwardly therefrom generally following the curvature of the blade, see FIG. 5. Referring to FIG. 2, the finger 25 is arcuate with its center line falling in a cylinder centered on the axis of the propeller. The propeller rotates counterclockwise as seen in FIG. 2 so that the finger 25 leads the leading edge 21 of its associated blade.

The body 29 of the finger 25 is approximately rectangular in cross-section and enlarges from its root in the blade to its outer end. The four edges 27 of the rectangular body should be as sharp as possible. The end 28 of the finger terminates in a plane perpendicular to the propeller axis and since the body of the finger projects at an acute angle to this plane, a sharp blade like edge 30 is created which forms the radial leading edge of the weed cutting finger.

The fingers 25 may be integrally molded with the propeller in most any casting process known to the art. The preferred material is stainless steel. The width of the body 29 of each finger starts out the same as the width of the blade 20 as it progresses from the hub. The blade leading edge 26 thins as it progresses from its root, but the body 29 of the finger maintains or increases its thickness, as illustrated, for strength and casting ease. The body 29 of the finger fairs into the surface of the blade behind the leading edge, resulting in a minimum of surface discontinuity. The top 31 and bottom 32 surfaces of the fingers 25 are substantially concentric surfaces of revolution whose axes lie on the axis of the propeller.

In an alternate configuration, the weed cutting members can be attached to the thrust washer 41 and the washer locked in alignment with the blades.

Particular note should be made of the fact that the fingers 25 are attached to the blades 20 of the prop at a point slightly removed from the hub 11, see FIG. 2. This structure helps the exhaust gases to escape even though weeds may be wound tightly around the exterior of the fingers 25.

Figure 3:
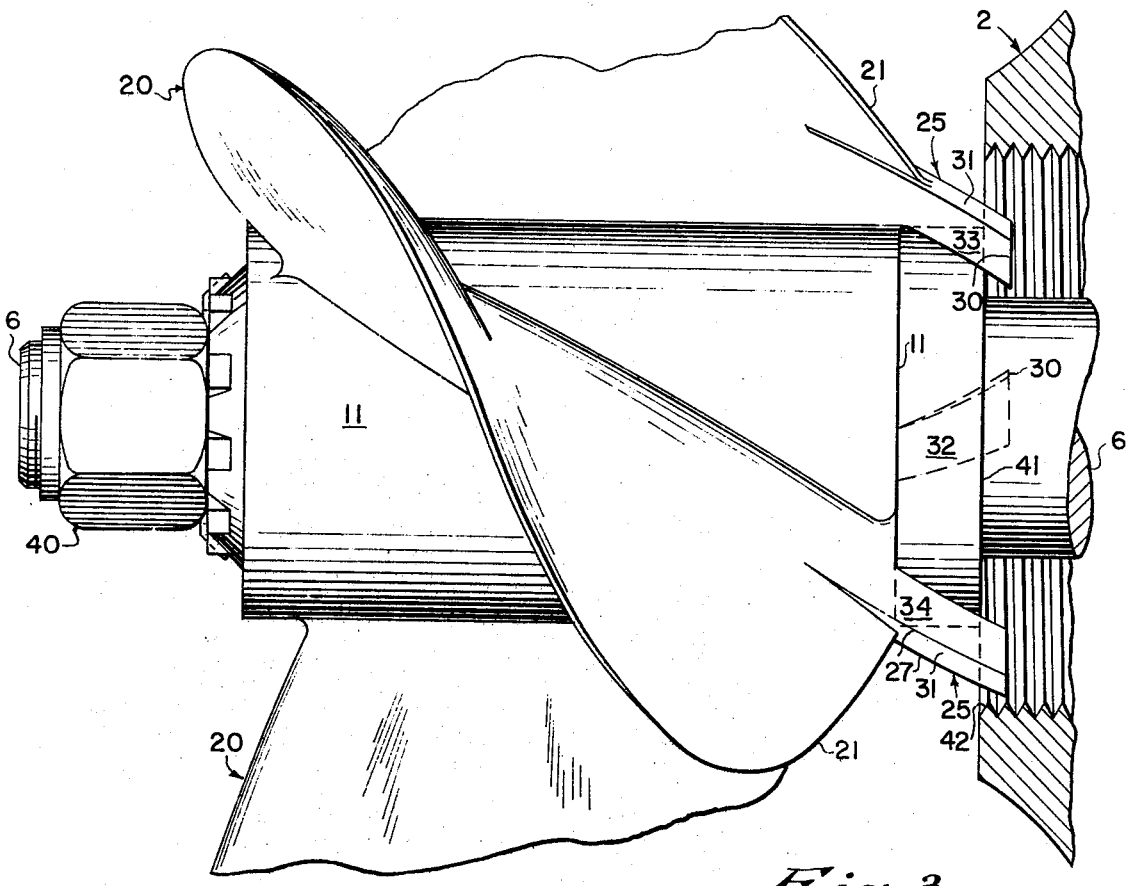
FIG. 3 is an enlarged view of portions of the propeller and gear case in FIG. 1.

FIGS. 1 and 3, illustrate the positioning of the propeller 10 with respect to the drive housing 1. The propeller is fixed axially as known to the art by a propeller nut 40 which threads onto the propeller shaft 6 and positions the prop against a thrust collar 41. As best seen in FIG. 3, the weed cutting fingers 25 extend inside the annular exhaust outlet 7 and into close relationship with the inside wall 42 of the gear case. This overlap and clearance are essentially the same as that which existed in the prior art between a T-H-E prop and the gear housing. This construction desirably allows for some axial movement of the propeller under reversing conditions and production tolerances.

In operation the propeller described has a high "surface air tolerance", that is, it can be operated with an upper portion of the blades breaking the water surface and not totally "break loose". It is theorized that it is this quality of the propeller, which is attributed to its rake and camber, that results in its satisfactory performance in the absence of the conventional through-hub-exhaust tube to carry the engine exhaust aft to a point well behind the blades. Prior to the invention experience indicated that it was necessary to carry the exhaust to a point aft of the prop to prevent the prop from "breaking loose" under conditions of turns, trim and acceleration normally imposed on a boat and motor during operation.

In operation, the fingers function to 1) wrap up the weeds outside of the exhaust passage, and 2) at higher speeds, chop up and throw off any weeds that have wrapped on at slow speeds. The cutting action may be enhanced by reversing or rapidly accelerating the propeller.

Improved propeller efficiency is achieved by the elimination of the need for the outer hub of the propeller that provided the exhaust tube. Experiments have shown that when the boat is on plane the exhaust bubble will take its own desired shape and will pass through the propeller at a radius about equal to the gear case torpedo size. With no tube the water outside of this exhaust bubble comes in contact only with the nicely designed and finished blade. With a tube, power is consumed by water drag on the outside of the tube, particularly any flare on the end commonly used to create a low pressure area behind the prop. Additionally flow over a small but significant portion of the blades is adversely affected by fillet radii and the resulting crude leading edge where the blades meet the hub.

One of the primary operational advantages of the propeller of the invention is improved acceleration on boats which are fast but difficult to get on plane, a condition most commonly the result of a far aft center of gravity. The most difficult stage of accelerating an outboard or stern drive at wide open throttle, particularly with higher pitched propellers needed for higher gear reduction units on fast boats, is the very initial period where the RPM is low and thus the power available to accelerate is low. The non-T-H-E propeller of the invention permits the exhaust gas to partially unload the propeller so that the engine can immediately wind to a higher speed and subsequent power output. This of course means operating momentarily at greater slip, but this affect disappears as the boat reaches planing speed.

Another operational advantage is improved reverse thrust. Through-hub-exhaust props generally perform poorly in reverse due to the exhaust gases having to pass back over the propeller, reducing static thrust to $\frac{1}{3}$ to $\frac{1}{2}$ of what it was in forward. Since the prop of the invention does not carry the exhaust to a point aft of the blades, this adverse effect is eliminated.

A further operational advantage attributed to the blade design is the relative insensitivity of the prop to installation height. Using prior art low rake T-H-E props the engine installation height is rather critical, at least as to maximum height on the transom. If the cavitation plate is installed much above the boat bottom, the lower rake prop will generally unload, "blow out" or "break loose" as planing speed is reached. Since the non-T-H-E prop was originally designed to operate partially out of the water, it is normally not detrimentally affected by surface air getting under the cavitation plate.

As can be seen from the foregoing, the invention provides a unique non-through-the-hub-exhaust propeller which provides significant operational advantages when used with an outboard or stern drive having underwater exhaust through the lower gear case housing.

While the principles of the invention have been described in connection with the above specific apparatus, it is to be clearly understood that this description is made only by way of example and not as a limitation to the scope of the invention.

I claim:

1. A non-through-hub-exhaust propeller having particular utility when used with marine outboard motors and stern drives having underwater exhaust through the lower gear case housing, said propeller including a hub and means for attaching said hub to a propeller drive shaft, and a plurality of blades extending radially outwardly of the hub, characterized by a plurality of finger-like weed cutting members attached to selected blades of the propeller, said members projecting forwardly of the leading edge of said blade, radially outwardly of said hub, and forming a forward projection of the driving face of the propeller blade.

2. The propeller of claim 1 wherein the body of said weed cutting members enlarge toward the outer end.

3. The propeller of claim 1 wherein the entire body of said weed cutting members lies radially outwardly and apart from the propeller hub.

* * * * *